US006679692B1

(12) United States Patent
Feuling

(10) Patent No.: US 6,679,692 B1
(45) Date of Patent: Jan. 20, 2004

(54) OIL PUMP

(76) Inventor: James J. Feuling, 673 E. "J" St., Chula Vista, CA (US) 91910

( * ) Notice: Subject to any disclaimer, the term of this patent is extended or adjusted under 35 U.S.C. 154(b) by 0 days.

(21) Appl. No.: 10/193,844

(22) Filed: Jul. 12, 2002

(51) Int. Cl.[7] ..... F04C 2/10; F04C 11/00

(52) U.S. Cl. ..... 418/171; 418/39; 418/182; 418/200

(58) Field of Search ..... 418/15, 39, 166, 418/171, 182, 200

(56) References Cited

U.S. PATENT DOCUMENTS

| | | | | |
|---|---|---|---|---|
| 3,242,867 A | * | 3/1966 | Mosebacher | 418/15 |
| 4,645,430 A | * | 2/1987 | Carleton | 418/171 |
| 5,226,798 A | * | 7/1993 | Eisenmann | 418/171 |
| 6,047,667 A | | 4/2000 | Leppanen et al. | |
| 6,116,205 A | | 9/2000 | Troxler et al. | |
| 6,264,451 B1 | * | 7/2001 | Murayama et al. | 418/171 |

FOREIGN PATENT DOCUMENTS

| | | | |
|---|---|---|---|
| EP | 0097138 | * 12/1983 | 418/39 |
| GB | 340111 | * 12/1930 | 418/139 |

* cited by examiner

*Primary Examiner*—John J. Vrablik
(74) *Attorney, Agent, or Firm*—Luce, Forward, Hamilton & Scripps, LLP

(57) ABSTRACT

A modular oil pump for use in combination with an internal combustion engine having a dry sump lubrication system. The device features a first gerotor pump having an intake port engageable in communication with at least one engine sump and having an discharge port engageable in sealed communication with a fluid reservoir for the dry sump system. A second gerotor pump, engageable in sealed communication with the fluid reservoir has a discharge port fluidly engageable with the engine lubrication system oil supply conduit. Both the first pump and second pump are assembled from separate housings, and cooperatively engaged inner and outer gears sized for rotation and in line mounting on the engine crankshaft inside a cavity in the housings. The volume pumping capacity of the first pump at a ratio to efficiently drain fluid and gas from the engine sumps and supply the reservoir with a constant supply of lubrication fluid. The device may be assembled from a kit having a plurality of different sized components to adjust the ratio of the pumping volume of the first pump to the second pump.

29 Claims, 2 Drawing Sheets

OIL PUMP

BACKGROUND OF THE INVENTION

1. Field of the Invention

The present invention relates to an oil pump for an internal combustion engine. More particularly it relates to an improved gerotor gear oil pump for use with a motorcycle engine employing a dry sump lubrication system and providing an improved design and ratio of scavenging pump capacity to engine supply side capacity. The design provides both improved performance and lubrication for the motorcycle engine and a gain in net horsepower in such an engine despite the use of increased gear size which would normally cause a decrease in net horsepower of the engine. Additionally, the modular design of the preferred embodiment provides the ability to assemble an oil pump with two or more pumping chambers into a single pump unit that is customizable to the required performance characteristics of the motorcycle for the type of riding intended.

In a preferred embodiment, the device features a multiple piece formed pump unit having a pressure pump housing and a scavenge pump housing separated by a separator plate and which are configured for cooperative sealed engagement in line and adjacent to each other to thereby house the rotating gerotor gears housed internally in each separate housing making up the pump housing. An outer wear plate, or sidewall formed by the engine to which the pump unit attaches defines the outer wall of a pressure chamber formed by the pump housing and the separator plate. The device also features the gears of the scavenge pump portion sized to specific pumping volume ratios in relation to the gears in the pressure pump portion to scavenge oil and gas pressure from the engine at a ratio sufficient to minimize windage and drag caused by oil occupying one or a plurality of sumps in the engine by draining such oil to a fluid reservoir supplying the pressure pump before it encumbers the rotation of internal engine components. Concurrently the scavenge pump portion, when in a correct ratio to the pressure pump fluid pumping capacity, ensures that the pressure pump is provided with a constant and uninterrupted supply of lubrication fluid from the fluid reservoir which can be delivered to engine components by the pressure pump during all phases of engine operation from idle to high RPM long duration operation.

The multi-piece design also allows the pump to be manufactured and sold as a kit which features cooperating pump gears and scavenge gears and pump housings and scavenge housings that are sized at different ratios in relation to each other. In this fashion the ratio of fluid volume pumped from the sumps by the scavenge pump in relation to the oil pumped by the pressure pump portion may be adjusted by using different sized gears and different sized engageable housing components. The chosen gears and housings form the two separate pumps which may then be assembled into a custom oil pump with the separator plate and the end plate or an engine wall as the case may be, with the desired ratio of scavenge pump volume to pressure pump volume to fit the intended use of the motorcycle.

2. Prior Art

Motorcycle engines in prior art generally employ a lubrication system that uses either a dry sump or wet sump. In both such wet sump and dry sump lubrication systems, the lubrication fluid, most commonly motor oil, collects in a sump at the bottom of the crankcase after the oil has been pumped to and lubricated various components of the engine. In a wet sump lubrication system, using a single oil pump, the oil is generally pumped directly from the crankcase sump or other sumps formed in the engine case, to the components of the engine requiring lubrication. In a dry sump lubrication system, the oil that collects in the engine sump, is pumped out of the crankcase sump by a first pump, which delivers the oil to a reservoir. Oil stored in the reservoir is then communicated via conduits to a second or pressure pump which pumps it to the parts of the engine requiring oil during operation through communicating conduits.

Gerotor oil pumps are well known in the art for pumping fluids and available from many sources such as Nichols Portland of Portland, Me. and Federal Mogul of Detroit, Mich. The theoretical flow ripple of the fluid pumped by gerotor pumps depends on the number of teeth in the pump gears and the specific geometry of the gerotor but in general more teeth means a lower flow ripple. Additionally, an inner gerotor gear with an even number of teeth typically has a lower fluid flow ripple than an inner gear having an odd number of teeth.

Since hydraulic power is a function of flow and pressure, the mechanical energy losses to the driving engine generally are caused by the viscous drag on the gears being driven. Consequently the gerotor with the smallest outside diameter will generally cause the lowest power loss to an engine driving it due to the developed viscous drag. Additionally smaller gears minimize vibration. Increasing gear size would generally be expected to cause a concurrent decrease in the net available horsepower of the engine driving the pump, since viscous drag is increased from the increased pumping and more horsepower is then required to power the pump. As such, engine manufacturers generally minimize the size of the gears to minimize vibration and power loss from the engine required to power them.

U.S. Pat. No. 6,047,667 (Leppanen) discloses an oil lubrication system using a gerotor pump for use in a motorcycle engine. However, Leppanen teaches the use of a one piece casing housing two adjacent pump gears and fails to teach any benefits derived from the critical ratio of the scavenging gear and resulting pumping volume to the pressure gear and resulting pressure pumping volume. Neither does Leppanen provide any ability to assemble pumps and adjust ratios of the scavenge and pressure section by the use of different components from a kit of different sized scavenge and pressure gears and casings all of which may easily be assembled into a functioning pump with optimum dimensions and ratios.

U.S. Pat. No. 6,116,205 (Troxler) also teaches the use of a gerotor oil pump for a motorcycle engine to drain two different sumps. The use of such a pump to simultaneously drain two different sumps on an engine, and pressurize oil passages on that engine is well known art in lubrication systems for internal combustion engines including motorcycles and automobiles. Troxler teaches the use of a one piece pump housing which is not designed to allow gear ratio adjustments and fails to teach any benefit from such adjustments or increasing the volume pumping size of the pumps. Neither does Troxler make any accommodation to the gear mounting on the drive shaft to allow for wear or end play which might cause the gears to bind with the body or endwalls when the pump is assembled.

As such, there is a pressing need for an oil pump with separate housings and separate scavenging and pressurizing chambers therein which may be specifically sized such that the ratio of the scavenging gears to the pressurizing gears is optimized to vent fluids from the engine sumps at an optimum rate during all operation speeds. Such a device should allow for maximum lubrication by the oil pressurizing pump at all engine speeds and optimize removal of oil and internal gas pressure from the sumps to minimize windage and interference by fluids in the sumps with the rotating mechanical components of the engine.

Still further, such a device when assembled from a plurality of different pump components into a single pump unit would offer the further benefit of the ability to choose specific gearing matched to specific assembleable housings or casings to form the two-chambered pump. By the careful selection of the fluid pumping volume of the scavenge portion of the formed pump to the pumping volume of the pressurizing portion, from a plurality of configurable casings and gears designed to interface and assemble to a pump, manufacturers, distributors, and users, can assemble a properly sized and proportioned pump with the optimum ratio of volume of the scavenging pump to the pressurizing pump to maximize both lubrication and net horsepower to each individual engine and the expected operating parameters of that engine. Additionally, by providing a means to accommodate end play and/or an out of tolerance mounting of the gears on the drive shaft, such a system would eliminate potential binding of the gears on the pump casings when the pumps are assembled and used.

SUMMARY OF THE INVENTION

Applicant's device is an improved two chambered gerotor oil pump for use on internal combustion engines. The preferred embodiments of the device, for use on a dry sump style engine, feature a scavenging pump chamber formed in a scavenging housing and further defined by a sidewall opposite a separator plate, and, an inline pressure pump chamber formed in a pressure housing and further defined by a separator plate between it and the scavenging pump and an opposing end wall. Gerotor gears operatively occupy both the scavenging pump chamber and the pressure pump chamber and are both situated for inline mounting on a driving shaft communicating axially through the center portion of both chambers. In some instances the sidewall of the scavenging chamber or exterior wall of the pressure chamber may be provided by mounting the assembled pump housings to the engine block or factory end plates or both the sidewall and the exterior wall may be provided as parts for use in with the assembled pump assembly to maintain tolerances between the parts.

In use in the current best embodiment the improved oil pump would be assembled from the various components to yield a pump for both scavenging lubricating fluids from one or a plurality of engine sumps and pumping such lubricating fluids for the engine used in combination herewith which has the best ratio of gear sizing to yield the pumping volume for the intended engine and the use of the intended engine. For example motorcycles for competition tend to reach high engine speeds and to constantly accelerate and decelerate such engine speeds. Conversely, street and highway driven motorcycles tend to accelerate less and to shift to higher gears for long periods of riding at highway speeds with constant but lower RPM than those encountered by racing motorcycles.

It is an object of this invention to provide an oil pump for internal combustion engines, especially motorcycles, which ratios the pumping volume of the scavenge pump to the pumping volume of the pressure pump, to maximize performance and minimize power loss.

Another objective of this invention is to provide such a multi chambered oil pump which is assembled from modular components allowing for the adjustment of gear sizes in each respective pump section to achieve the best size and ratio of pumping volume therebetween for the intended installation of the pump.

An additional objective of this invention is to provide a multi chambered oil pump which is assembled from modular components allowing for the easy replacement and repair of the assembled pump components.

A still further object of this invention is the provision of an oil pump with a scavenging pump to pressure pump pumping volume ratio which minimizes or eliminates horsepower loss to the driving engine by removing excess liquid and gas from the engine sumps which interfere with mechanical movement, while providing an adequate supply of lubrication fluid to a reservoir and communicating pressure pump for engine lubrication purposes.

Further objectives of this invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF PREFERRED EMBODIMENTS OF THE DISCLOSED DEVICE

Figure 1:
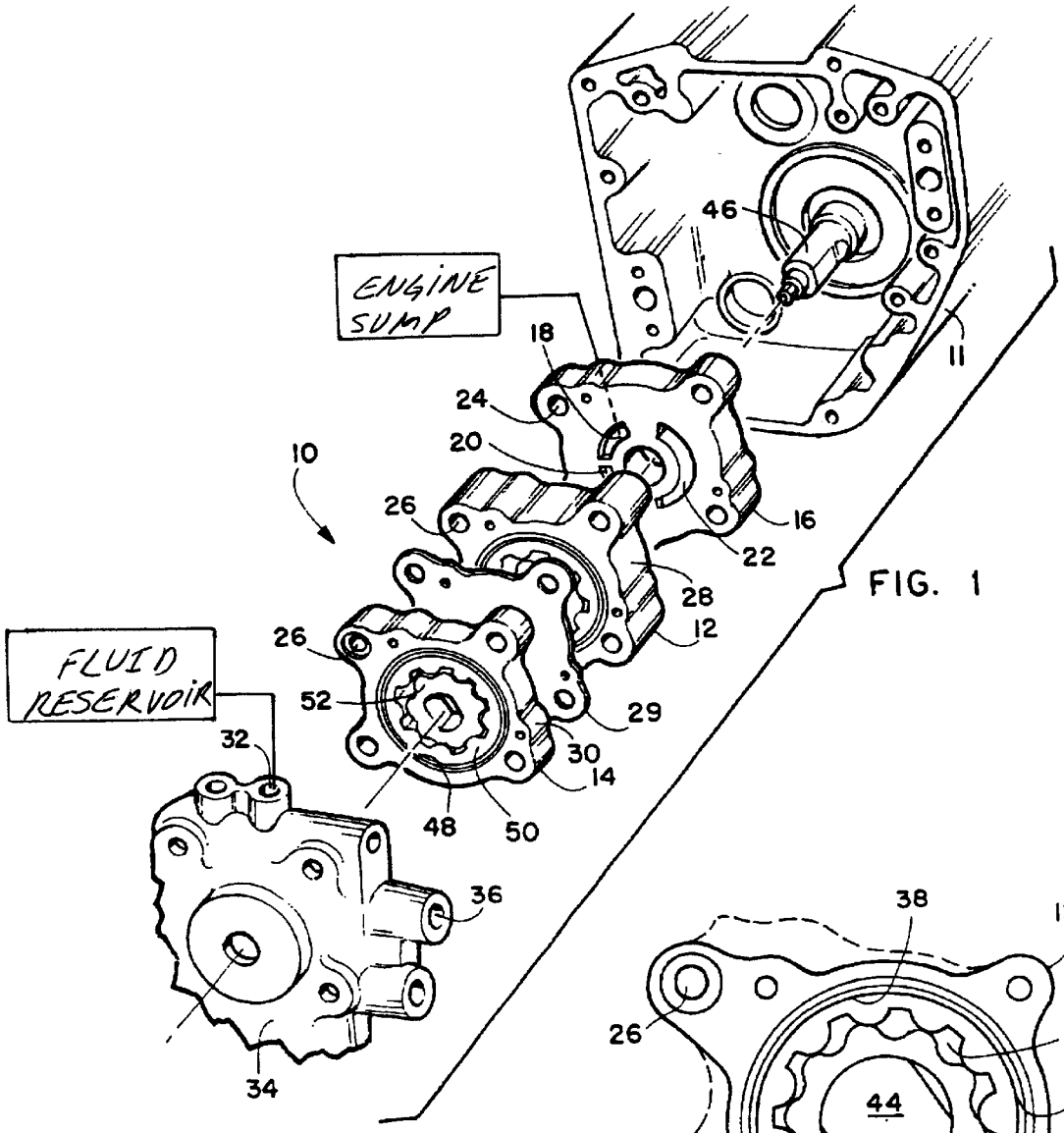
FIG. 1 is a perspective view of the disclosed device depicting the components of the multi chambered oil pump and their attachment to a motorcycle engine used in combination herewith.

Referring now to the drawings FIGS. 1–4 disclose the preferred embodiments of the herein disclosed device 10 which is a multi chambered oil pump for operative attachment to, and use in combination with, an internal combustion engine 11 such as a motorcycle.

In a first preferred embodiment as shown in FIG. 1 the device 10 features a pair of gerotor pumps to form the device 10 which has a scavenging pump 12 mounted in line with a pressure pump 14. As shown, a pump porting plate 16 provides a means to interface the device 10 with an engine 11 and the oil conduits of the engine and port the lubricating fluid such as oil from one or a plurality of engine sumps (not shown) to one or a plurality of scavenging intake ports, in this case a first savaging intake port 18 and a second scavenging intake port 20 through which oil is drawn into the scavenging pump 12 by negative pressure generated by the scavenging pump 12 at the two intake ports. The two intake ports 18 and 20, would communicate fluid into the scavenging pump 12 and through a sidewall. This sidewall might also be formed by the engine casing with one or a plurality of intake ports providing fluid to the scavenging pump 12 but the current best mode provides the porting plate 16 for attachment to the engine 11 for such an interface.

The scavenging pump 12 receives oil from the intake ports 18 and 20 and therein discharges the pressurized oil through the scavenging discharge port 22 in the porting plate 16 which communicates the pressurized oil through an internal conduit to a porting plate discharge conduit 24. This is the conventional manner of gerotor pumps which receive oil through an elongated or curved apertures a sidewall moving it to a similarly shaped aperture forming the discharge port also in a sidewall. The porting discharge conduit 24 communicates oil from the scavenging pump to an oil reservoir (not shown) for storage and communication to the pressure pump 14.

The favored configuration shown in FIG. 1 is best suited for use with motorcycles using a dry sump system which communicate oil from one or a plurality of engine sumps to a scavenging pump 12 which is in fluid communication with an oil reservoir (not shown). The oil reservoir in turn is in fluid communication with the pressure intake port 32 of the pressure pump 14 which commentates through a pressure sidewall or endplate 34 to the pressure pump 14. The rotating gears receive the oil between them from the intake port 32 and rotate toward the discharge port 36 thereby discharging the oil to the engine through the pressure discharge port 36 which is in sealed communication with an engine oiling system intake conduit and which distributes the pressurized oil to various engine parts needing it. The discharge port is operatively located to communicate through the endplate 34 to receive oil from the pressure pump 14. The discharge port might also be placed in the engine block to mate with the side of the pressure pump 14 however the current best mode is anticipated for use with a properly channeled endplate 34 which sandwiches the assembled device 10 between the endplate 34 and the motor cycle engine 11 and with the gears mounted upon the driving shaft 46 which in the illustrated embodiment has a relief 47 extending from a shoulder 49 formed at a distal end of the driving shaft 46 to accommodate the gear mounting thereon.

Figure 2:
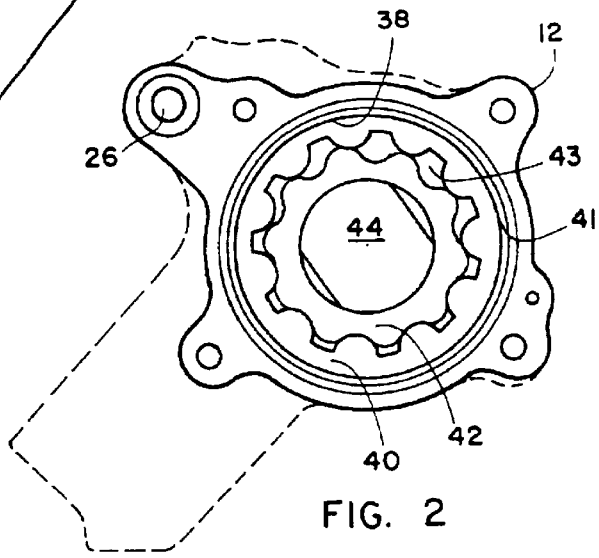
FIG. 2 is a front-view of the internal gerotor gears of the scavenging pump.

Further shown in FIG. 1 is the current best mode of the device 10 which employs a plurality of gerotor style pumps depicted as scavenge pump 12 and pressure pump 14. Gerotor pumps typically employ two rotating rotors or gears. As best shown in FIG. 2, an outer gear, which as depicted is the scavenge outer gear 40 has a smooth circumference 41 designed to rotate inside an operatively dimensioned circular chamber, which as shown as circular cavity 38. The outer gear 40 has a geared interior chamber 43. An inner gear which in this case is shown as inner scavenge gear 42, having one less tooth than the outer gear, rotates inside the outer gear when turned by the driving shaft 46. Since the outer gear 40 has a centerline at a fixed eccentricity from the centerline of the inner gear 42, and one more tooth than the inner gear, both the outer gear and inner gear will rotate when powered by the driving shaft 46. The inner chamber 43 draws in fluid communicated thereto through one or a plurality of intake ports formed in a side wall and best depicted in FIG. 1 as the first scavenge intake port 18 and second scavenge intake port 20 however the number of intake ports will depend on the number of engine sumps being scavenged by the pump. As both gears rotate on the driving shaft 46 the empty space in inner chamber 43 where the gears do not engage decreases in size as it rotates from communication with the intake ports 18 and 20 to communication with the scavenge discharge port 22 thereby forcing fluid out into the scavenge discharge port 22 which is in fluid communication with the engine reservoir. The pressure pump 14 works in essentially the same manner.

As shown in FIG. 1, in the current best mode, the scavenging discharge port 24 communicates pressurized oil through the scavenge discharge passage 26 which communicates through the scavenge housing 28, the divider plate 29, and the pressure housing 30 when the components are in assembled in line and in operative sealed engagement. The scavenge discharge passage 26 is in sealed fluid communication with an internal engine reservoir. Fluid conduits from the engine reservoir therein communicate oil to the pressure intake port 32 and thus supplies oil scavenged from the sumps by the scavenging pump 12 to the pressure pump 14.

The pressure pump 14 pressurizes the oil further wherein it is discharged from the pressure pump 14 through the pressure discharge port 36 which is in sealed communication with the appropriate intake port on the engine requiring pressurized fluid to lubricate and operate the engine during operation. Pressurized fluid from the pressure discharge port 36 may also be sent through a filter means and may be regulated for proper pressure during its return to the appropriate port in the engine 11 by a means to regulate fluid pressure.

As noted, the device 10 is modular in construction with separate scavenging pump 12 and pressure pump 14 sections which assemble in line to mount upon the driving shaft 46. As shown in FIG. 2 the scavenging pump section features a scavenge housing 28 with a circular cavity 38 formed therein sized to accommodate the outer scavenge gear 40 and the inner scavenge gear 42. A notched aperture 44 is dimensioned for cooperative operative engagement over a driving shaft 46 which is powered by the engine 11 during operation and provides the rotational power to operate the scavenging pump 12 during operation of the engine 11. In the current best mode, a counter bore 45 is formed on both sides of the notched apertures 44 of both the inner scavenge gear 42. This counter bore 45 provides a means to accommodate lateral translation of the driving shaft 46 also known as end play, as well as a means to accommodate the tolerances of manufacturing which could cause the gear to bind when mounted, and still allow the device 10 to be assembled in line from two different pump sections. This counter bore 45 thereby allows for some end play of the driving shaft 46 during operation and the easy assembly of the gears inline on the driving shaft 46 without binding after assembly even if the tolerances of the engine components have increased due to wear or other reasons.

The pressure pump 12 is also of modular construction featuring a pressure housing 30 having a circular aperture 48 dimensioned for operative engagement of the rotating outer pressure gear 50 therein which is driven by the inner pressure gear 52 which also has a center aperture dimensioned for cooperative engagement over the driving shaft 46 when the device is assembled and cooperatively engaged over the driving shaft 46.

Figure 3:
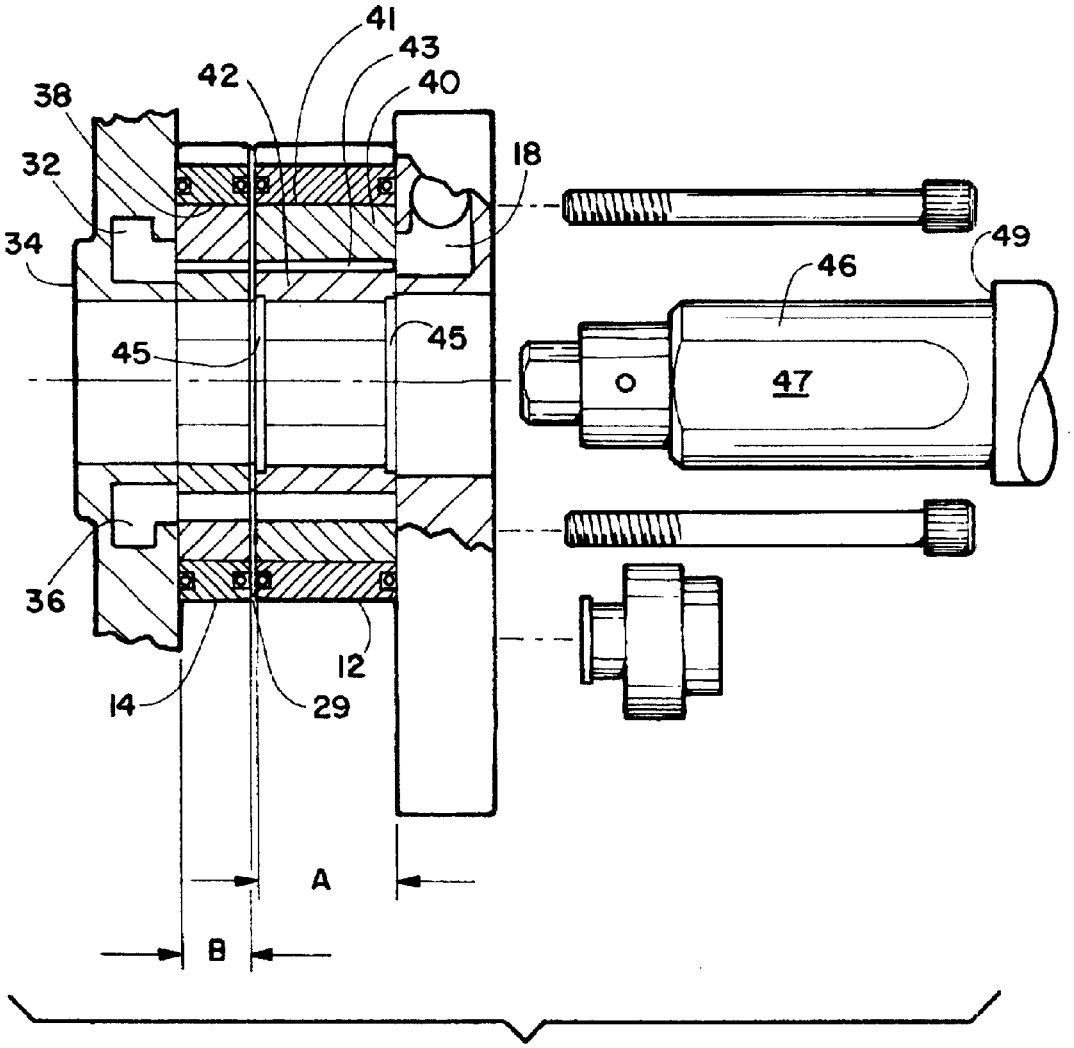
FIG. 3 is a side cut away view of the multi chambered modular oil pump showing the diameter ratios of the gears of the two separate pumps and inline relationship with the shaft.
Figure 4:
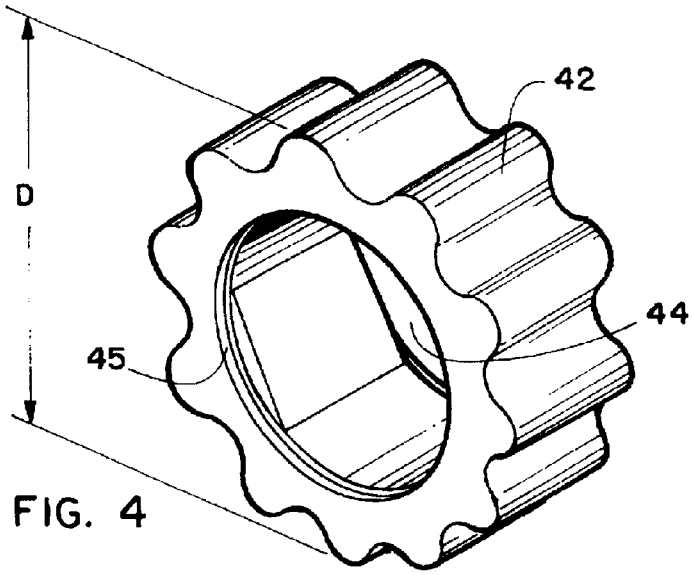
FIG. 4 depicts scavenge pump inner gerotor gear having a counter bore formed on the aperture for accommodating shaft play and manufacturing tolerances when mounting the gear a relief formed on the driving shaft.

As shown in FIG. 3, the device 10 is of modular construction connected by bolts (unnumbered) so as to be readily disassembled provides the ability to be assembled from different components of differing sizes yielding different fluid pumping volumes depending on the engine to which they are attached. When the device 10 was assembled in the current best mode, and engaged with a HARLEY DAVIDSON® Twin Cam 88 engine, experiments with the ratios of the fluid pumping volume of the scavenging gears 40 and 42 to the fluid pumping volume of the pressure gears 50 and 52 showed an unexpected result. When larger than original gears were used for both the pressure pump 14 and the scavenging pump 12, instead of losing horsepower as would be expected from the larger gears requiring more force to rotate, the engine actually showed an increase in net horsepower. This unexpected result once achieved was improved on by carefully adjusting gears with a substantially equal diameter "D" and with a determined ratio of the width "A" of gears of the scavenging pump 12 to the width "B" of the gears of the pressure pump 14 to yield the optimum fluid pumping volume of the scavenging pump 12 to the pressure pump 14. In the current best mode as used in combination with a HARLEY DAVIDSON® Twin Cam 88 the device 10 is operatively mounted, sandwiched between a factory supplied endplate and the engine 11. The endplate on this model of HARLEY DAVIDSON provides conduits to communicate oil from the scavenging pump 12 to the reservoir and from the reservoir to the pressure pump 14 and then from the pressure pump 14 back to the engine 11. In this application, a gear diameter "D" in a range of 1.8 inches to 2.25 inches works best with the current best embodiment for this engine being substantially 2 inches. On the same engine it was found that assembling the respective gears with a ratio of with "A" to width "B" with a ratio between 1.9 to 1 and 2.5 to 1 with the current best ratio of "A" to "B" being substantially 2.42 to 1. The higher fluid pumping volume of the scavenging pump 12 to the pressure pump 14 provides not only insures an adequate supply of oil to the reservoir to feed the pressure pump 14 at all engine speeds, the scavenging pump 12 uses a portion of the extra volume pumping capability to pull gas from the engine sumps and interior thereby reducing internal engine pressures as well as windage from oil in the sumps. The exact ratio of volume pumping chosen would depend on the intended type of application or use of the engine however the aforementioned ratios work exceptionally well with the HARLEY DAVIDSON® Twin Cam 88 engine when the device 10 is assembled from both pumps 12 and 14, and sandwich mounted between the factory endplate and the engine 11. The device 10 in this pumping volume ratio configuration would also work well in similar motorcycle engines and the addition of the counter bore 45 alleviated gear binding in the scavenge pump 12 against the side wall or divider plate 29 from out of tolerance engine specifications or wear.

By assembling the device 10 using modular components to form both the scavenging pump 12 and the pressure pump 14 which assemble in line for mounting on the driving shaft 46, it is easy to adjust the ratio of the fluid pumping volume of the scavenging pump 12 in relation to the fluid pumping volume of the pressure pump 14. This is done by simply substituting pressure housings 28 with larger or smaller widths "B" for assembly into a complete device 10 along with scavenging housings 28 having different widths "A." The appropriately sized gears generally of equal diameter, would occupy the circular cavity 38 of the pressure housing 30 and the circular aperture 38 of the scavenge housing 28 respectively. Thus, when a user wishes to change the ratio of fluid pumping volume of the scavenging pump 12 to that of the pressure pump 14, they can simply assemble the device 10 from a kit of components containing a plurality of different widths "A" and "B" to yield the ratio desired to appropriately scavenge fluid and gas pressure from the engine sumps to minimize fluid interference with mechanical action yet provide optimum pressure and volume for engine lubrication and operation. As is obvious to those skilled in the art, the gears of the respective pumps need not be the same diameter "D" and it would also be possible to adjust the respective fluid pumping volumes of the two pumps by changing one of the pumps to a larger diameter gear and casing. However using equal diameter "D" works best in the current preferred embodiments since it allows for easy assembly of the components inline.

While all of the fundamental characteristics and features of the multi chambered oil pump have been described herein, with reference to particular embodiments thereof, a latitude of modification, various changes and substitutions are intended in the foregoing disclosure and it will be apparent that in some instances, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined herein.

What is claimed is:

1. A modular oil pump for use in combination with an internal combustion engine having a driving shaft providing rotational power, one or a plurality of engine sumps for collecting lubricating fluid, a fluid reservoir for storing oil for lubrication, and an oil supply conduit for communicating oil from said reservoir to engine parts, comprising:

a first gerotor pump, said first gerotor pump having an intake port engageable in communication with at least one engine sump and having a discharge port engageable in sealed communication with a fluid reservoir;

a second gerotor pump, said second gerotor pump having an intake port engageable in sealed communication with said fluid reservoir and a discharge port engageable in sealed communication with said oil supply conduit;

said first pump having a first housing and an inner gear engaged with an outer gear inside a first cavity, said inner gear having a mounting aperture therein with a center axis communicating axially therethrough;

said second pump having a second housing with an interior gear engaged with an exterior gear inside a second cavity, said interior gear having a mounting passage therein with a center axis communicating axially therethrough; and said first pump attachable to said second pump to form a pump unit which can be readily disassembled by detaching said first and second housings with said center axis of said inner gear in line with said center axis of said interior gear, wherein said pump unit is engageable with said engine with said driving shaft cooperatively engaged with said inner gear and said interior gear to provide rotational power thereto.

2. The modular oil pump for use in combination with an internal combustion engine of claim 1 wherein said driving shaft is the engine crankshaft.

3. The modular oil pump for use in combination with an internal combustion engine of claim 1 additionally comprising:

said outer gear having a diameter substantially equal to that of said exterior gear thereby forming a matched gear diameter; and said matched gear diameter being between a minimum of 1.9 inches and a maximum of 2.25 inches.

4. The modular oil pump for use in combination with an internal combustion engine of claim 1 additionally comprising:

said first housing, said inner gear and said an outer gear all having a first width dimension thereby determining a first fluid pumping volume;

said second housing, said interior gear and said exterior gear, all having a second width dimension thereby determining a second fluid pumping volume; and said first fluid pumping volume exceeding said second fluid pumping volume.

5. The modular oil pump for use in combination with an internal combustion engine of claim 4 additionally comprising:

said first fluid pumping volume equaling at least twice said second fluid pumping volume.

6. The modular oil pump for use in combination with an internal combustion engine of claim 1 additionally comprising:

said first inner gear having a diameter substantially equal to that of said interior gear;

said outer gear having a diameter substantially equal to that of said exterior gear;

said first housing, said inner gear, and said an outer gear all having a first width dimension thereby determining a first fluid pumping volume;

said second housing, said interior gear and said exterior gear, all having a second width dimension thereby determining a second fluid pumping volume; and said first fluid pumping volume exceeding said second fluid pumping volume.

7. The modular oil pump for use in combination with an internal combustion engine of claim 6 additionally comprising:

said first pumping volume equaling at least twice said second pumping volume.

8. The modular oil pump for use in combination with an internal combustion engine of claim 6 additionally comprising:

said outer gear having a diameter substantially equal to that of said exterior gear thereby forming a matched gear diameter; and said matched gear diameter being between a minimum of 1.9 inches and a maximum of 2.25 inches.

9. The modular oil pump for use in combination with an internal combustion engine of claim 6 additionally comprising:

said first pumping volume being in a range between a minimum of 1.9 to 1 of said second pumping volume and a maximum of 2.5 to 1 of said second pumping volume.

10. The modular oil pump for use in combination with an internal combustion engine of claim 9 additionally comprising:

said outer gear having a diameter substantially equal to that of said exterior gear thereby forming a matched gear diameter; and said matched gear diameter being between a minimum of 1.9 inches and a maximum of 2.25 inches.

11. The modular oil pump for use in combination with an internal combustion engine of claim 1 further comprising:

means to prevent binding of said inner gear from lateral translation or out of tolerance positioning of said driving shaft.

12. The modular oil pump for use in combination with an internal combustion engine of claim 11 wherein said means to prevent binding of said inner gear from lateral translation or out of tolerance positioning of said driving shaft is a counter bore formed at the point of communication of said mounting aperture and a side surface of said inner gear.

13. The modular oil pump of claim 1, further comprising:

a first gerotor pump, said first gerotor pump formed having an intake port engageable in communication with at least one engine sump and having a discharge port engageable in sealed communication with a fluid reservoir;

a second gerotor pump, said second gerotor pump having an intake port engageable in sealed communication with said fluid reservoir and a discharge port engageable in sealed communication with said oil supply conduit;

said first pump having a first housing chosen from a kit containing a plurality of different housings having differently dimensioned first cavities therein;

said first pump having an inner gear cooperatively engageable with an outer gear sized for rotational operative engagement inside said first cavity, said outer gear chosen from a set containing a plurality of said outer gears, and said inner gear chosen from a collection containing a plurality of differently sized inner gears;

said inner gear having a mounting aperture therein with a center axis communicating axially therethrough;

said second pump having a second housing having chosen from a kit containing a plurality of different second housings having differently dimensioned first cavity therein;

said second pump having an interior gear cooperatively engageable with an exterior gear sized for rotational operative engagement inside said second cavity;

said interior gear having a mounting passage therein with a center axis communicating axially therethrough; and said first pump attachable to said second pump to form a pump unit with said center axis of said inner gear in line with said center axis of said interior gear, wherein said pump unit may be assembled from components forming said first pump and said second pump to adjust the pumping volume ratio therebetween, and said pump unit so assembled is engageable with said engine with said driving shaft cooperatively engaged with said inner gear and said interior gear to provide rotational power thereto.

14. The modular oil pump for use in combination with an internal combustion engine of claim 13 further comprising:

means to prevent binding of said inner gear from lateral translation or out of tolerance positioning of said driving shaft.

15. The modular oil pump for use in combination with an internal combustion engine of claim 14 wherein said means to prevent binding of said inner gear from lateral translation or out of tolerance positioning of said driving shaft is a counter bore formed at the point of communication of said mounting aperture and a side surface of said inner gear.

16. An improved modular oil pump for use in combination with a HARLEY DAVIDSON Twin Cam 88 engine, having a drive shaft providing rotational power, an engine sump and a cam sump for collecting lubricating fluid, a fluid reservoir for storing oil for lubrication, an endplate having fluid passages therein, and an oil supply conduit for communicating oil from said reservoir to engine parts, comprising:

a first gerotor pump, said first gerotor pump having an intake port engageable in communication with said engine sump and said cam sump and having a discharge port engageable in sealed communication with a fluid reservoir;

a second gerotor pump, said second gerotor pump having an intake port engageable in sealed communication with said fluid reservoir and a discharge port engageable in sealed communication with said oil supply conduit;

said first pump having a first housing and an inner gear engaged with an outer gear inside a first cavity, said inner gear having a mounting aperture therein with a center axis communicating axially therethrough;

said second pump having a second housing with an interior gear engaged with an exterior gear inside a second cavity, said interior gear having a mounting passage therein with a center axis communicating axially therethrough; and said first pump attachable to said second pump to form a pump unit which can be readily disassembled by detaching said first and second housings with said center axis of said inner gear in line with said center axis of said interior gear, wherein said pump unit is engageable with said engine in a position sandwiched between said engine and said endplate, with said drive shaft cooperatively engaged with said inner gear and said interior gear to provide rotational power thereto.

17. The improved modular oil pump of claim 16 further comprising:

said outer gear having a diameter substantially equal to that of said exterior gear thereby forming a matched gear diameter; and said matched gear diameter being between a minimum of 1.9 inches and a maximum of 2.25 inches.

18. The improved modular oil pump of claim 16 further comprising:

said first housing, said inner gear and said an outer gear having a first width dimension thereby determining a first fluid pumping volume;

said second housing, said interior gear and said exterior gear, all having a second width dimension thereby determining a second fluid pumping volume; and said first fluid pumping volume exceeding said second fluid pumping volume.

19. The improved modular oil pump of claim 18 further comprising:

said first fluid pumping volume equaling at least twice said second fluid pumping volume.

20. The improved modular oil pump of claim 19 further comprising:

said first pumping volume equaling at least twice said second pumping volume.

21. The improved modular oil pump of claim 19 further comprising:

said first pumping volume being in a range between a minimum of 1.9 to 1 of said second pumping volume and a maximum of 2.5 to 1 of said second pumping volume.

22. The improved modular oil pump of claim 21 further comprising:

said outer gear having a diameter substantially equal to that of said exterior gear thereby forming a matched gear diameter; and said matched gear diameter being between a minimum of 1.9 inches and a maximum of 2.25 inches.

23. The improved modular oil pump of claim 16 further comprising:

said first inner gear having a diameter substantially equal to that of said interior gear;

said outer gear having a diameter substantially equal to that of said exterior gear;

said first housing, said inner gear, and said an outer gear having all having a first width dimension thereby determining a first fluid pumping volume;

said second housing, said interior gear and said exterior gear, all having a second width dimension thereby determining a second fluid pumping volume; and said first fluid pumping volume exceeding said second fluid pumping volume.

24. The improved modular oil pump of claim 23 further comprising:

said outer gear having a diameter substantially equal to that of said exterior gear thereby forming a matched gear diameter; and said matched gear diameter being between a minimum of 1.9 inches and a maximum of 2.25 inches.

25. The modular oil pump for use in combination with an internal combustion engine of claim 16 further comprising:

means to prevent binding of said inner, gear from lateral translation or out of tolerance positioning of said driving shaft.

26. The modular oil pump for use in combination with an internal combustion engine of claim 25 wherein said means to prevent binding of said inner gear from lateral translation or out of tolerance positioning of said driving shaft is a counter bore formed at the point of communication of said mounting aperture and a side surface of said inner gear.

27. An improved modular oil pump for use in combination with a HARLEY DAVIDSON Twin Cam 88 engine, having a drive shaft providing rotational power, an engine sump and a cam sump for collecting lubricating fluid, a fluid reservoir for storing oil for lubrication, an endplate having fluid passages therein, and an oil supply conduit for communicating oil from said reservoir to engine parts, comprising:

a first gerotor pump, said first gerotor pump having an a first intake port engageable in communication with said engine sump and a second intake port engageable in communication with said cam sump and having an discharge port engageable in sealed communication through conduits in an endplate, with a fluid reservoir;

a second gerotor pump, said second gerotor pump having an intake port engageable in sealed communication through intake conduits in said endplate, with said fluid reservoir and a discharge port engageable in sealed communication through discharge conduits in said endplate, with said oil supply conduit;

said first pump having a first housing and an inner gear engaged with an outer gear inside a first cavity, said inner gear having amounting aperture therein with a center axis communicating axially therethrough;

said second pump having a second housing with an interior gear engaged with an exterior gear inside a second cavity, said interior gear having a mounting passage therein with a center axis communicating axially therethrough; and said first pump attachable to said second pump to form a pump unit which can be readily disassembled by detaching said first and second housings with said center axis of said inner gear in line with said center axis of said interior gear, wherein said pump unit is engageable with said engine in a position sandwiched between said engine and said endplate, with said drive shaft cooperatively engaged with said inner gear and said interior gear to provide rotational power thereto.

28. The modular oil pump for use in combination with an internal combustion engine of claim 27 further comprising:

means to prevent binding of said inner gear from lateral translation or out of tolerance positioning of said driving shaft.

29. The modular oil pump for use in combination with an internal combustion engine of claim 28 wherein said means to prevent binding of said inner gear from lateral translation or out of tolerance positioning of said driving shaft is a counter bore formed at the point of communication of said mounting aperture and a side surface of said inner gear.

* * * * *